US008272081B2

(12) United States Patent
Anderson, Jr. et al.

(10) Patent No.: US 8,272,081 B2
(45) Date of Patent: Sep. 25, 2012

(54) TOILET SEAT LIFT DEVICE

(76) Inventors: Henry M. Anderson, Jr., Belding, MI (US); Amber L. Kirchner, Kewaskum, WI (US)

( * ) Notice: Subject to any disclaimer, the term of this patent is extended or adjusted under 35 U.S.C. 154(b) by 292 days.

(21) Appl. No.: 12/652,398

(22) Filed: Jan. 5, 2010

(65) Prior Publication Data

US 2011/0162138 A1 Jul. 7, 2011

(51) Int. Cl.
*A47K 13/10* (2006.01)

(52) U.S. Cl. ..... 4/667

(58) Field of Classification Search ..... 4/667, 246.1; 297/DIG. 10
See application file for complete search history.

(56) References Cited

U.S. PATENT DOCUMENTS

| | | | | |
|---|---|---|---|---|
| 4,031,576 | A | 6/1977 | Epstein | |
| 4,453,766 | A * | 6/1984 | DiVito | 297/316 |
| 4,587,678 | A * | 5/1986 | Love et al. | 4/667 |
| 4,993,085 | A | 2/1991 | Gibbons | |
| 4,995,120 | A * | 2/1991 | Tager | 4/246.1 |
| 5,189,739 | A | 3/1993 | Thierry | |
| 5,309,583 | A | 5/1994 | White et al. | |
| 5,318,058 | A * | 6/1994 | Zimmerman | 135/68 |
| 5,561,872 | A | 10/1996 | Phillips | |
| 5,661,858 | A | 9/1997 | House et al. | |
| 6,161,229 | A * | 12/2000 | Ryan et al. | 4/667 |
| 6,189,164 | B1 | 2/2001 | Krapu | |
| 6,360,382 | B1 | 3/2002 | Karash | |
| 6,438,769 | B1 | 8/2002 | Luckenbill | |
| 6,507,961 | B1 | 1/2003 | Ming-Hwa | |
| 6,553,585 | B1 | 4/2003 | Lundstrom | |
| 6,754,917 | B1 | 6/2004 | Rhoades | |
| 7,293,297 | B2 * | 11/2007 | Hayashi et al. | 4/246.1 |
| 2005/0235414 | A1 | 10/2005 | Cavanagh | |
| 2006/0042005 | A1 | 3/2006 | Johnson et al. | |
| 2006/0048296 | A1 | 3/2006 | Sutou et al. | |
| 2007/0039097 | A1 | 2/2007 | Waldal | |
| 2007/0209111 | A1 | 9/2007 | Boger et al. | |
| 2008/0038107 | A1 | 2/2008 | Henshaw et al. | |

* cited by examiner

*Primary Examiner* — Gregory Huson
*Assistant Examiner* — Janie Christiansen
(74) *Attorney, Agent, or Firm* — Joseph S. Heino; Patrick M. Bergin

(57) ABSTRACT

A lift device replaces the toilet seat and seat cover of a conventional toilet. The lift device provides a portion that overlays the toilet bowl area and a portion that supports the forward elements of the assembly. The lift device further provides a toilet seat and a horizontally-disposed seat pivot shaft located to the front of the device. A reversible electric motor with a worm gear drive engages a worm wheel segment attached to the seat pivot shaft for raising and lowering the toilet seat as desired or required. This action assists the user in positioning himself or herself onto the toilet and in lifting the user from the toilet. The raising and lowering movement can also be alternatively actuated by the user or by an assistant-actuated override device, such as when the user is assisted by a care giver.

19 Claims, 4 Drawing Sheets

TOILET SEAT LIFT DEVICE

FIELD OF THE INVENTION

The present invention relates generally to toilets. It also relates to lift devices of the type that are used to lift a person, and to lift a person from a seated position to a standing position, in particular. More specifically, the device of the present invention relates to a toilet seat lift device that can provide incapacitated persons with assistance in their own use, or in their accompanied use, of a toilet.

BACKGROUND OF THE INVENTION

Water flush toilets are a common fixture in most modern bathrooms, and are found both in the home and in institutional healthcare facilities. The physical configuration and design of the typical toilet has remained much the same in over sixty years. Although common and typically easy to use for most individuals, toilets of current configuration and design can present substantial problems to incapacitated, infirmed or disabled persons. The most basic problem encountered is the person's ability to lower himself or herself down onto the toilet seat and to then raise himself or herself up from the toilet seat. Insufficient joint stability, muscle weakness and other physical problems can make this a most formidable task indeed.

There have been previous attempts to design and fabricate lift devices to assist incapacitated, infirmed or disabled persons with lowering them down onto a toilet seat and then with raising them up from the toilet seat. In the experience of these inventors, however, the devices of the prior art are substantially more complex than they need to be, or should be. Such complex devices can be difficult to use and may not be usable in surroundings where clearance between the toilet and other fixtures is minimal. Accordingly, these inventors believe that there is a need for a simple, inexpensive, easy-to-install and easy-to-use lift device that will provide incapacitated, infirmed or disabled persons with the ability to be lowered onto or raised from a toilet, by themselves or with assistance from a health care provider.

Such a lift device would utilize a portion of the toilet seat itself as the primary vehicle for lowering and raising the individual. Such a lift device, of necessity, would be also need to be capable of being used with, and secured to, a wide variety of toilet bowls of conventional manufacture. Such a lift device would also utilize a minimal footprint for suitable use within a variety of settings.

SUMMARY OF THE INVENTION

In accordance with the foregoing, the present invention provides a lift device that replaces the toilet seat and seat cover of a conventional toilet. To attach the lift device to a conventional toilet, the two bolts in the back of the existing seat and cover combination are first removed, which allows the removal of the existing seat and cover combination. The new lift device that replaces this old combination comprises a completely new frame and plate assembly. The frame and plate assembly comprises a first portion that overlays the toilet bowl area and a second portion that supports the forward elements of the assembly, resulting in the stability of a three-point contact configuration.

More specifically, and to the rear of the assembly, the plate of the first portion is positioned onto the top planar surface of the toilet bowl and two studs locate the device relative to the toilet seat mounting holes. The studs are secured with washers and wing nuts or other suitable mounting and fastening means. To the front of the plate assembly, the frame comprises a pair of vertically-adjustable support tubes, one to either side of the toilet. Each support tube further includes a vertically adjustable leg within each of the tubes and a foot disposed at the bottom of each leg, the feet being positioned on the floor adjacent to and disposed relatively closely to each side of the toilet bowl base. This configuration also allows usage of the lift device within many facilities where toilet clearance might otherwise be an issue.

The lift device further comprises a toilet seat and a horizontally-disposed seat pivot shaft, also located to the front of the frame and plate assembly. A small reversible electric motor with a worm gear drive engages a worm wheel segment that is attached to the seat pivot shaft for raising and lowering the toilet seat as desired or required. This action, in turn, assists the user in positioning himself or herself onto the toilet and in lifting the user from the toilet. The raising and lowering movement is actuated by means of a push button that is mounted in a support handle that is disposed to the top of one or both of the support tubes. The raising and lowering movement can also be alternatively actuated by the user or by an assistant-actuated override device, such as when the user is assisted by a care giver.

The foregoing and other features of the lift device of the present invention will be apparent from the detailed description that follows.

DETAILED DESCRIPTION OF THE INVENTION

Figure 1:
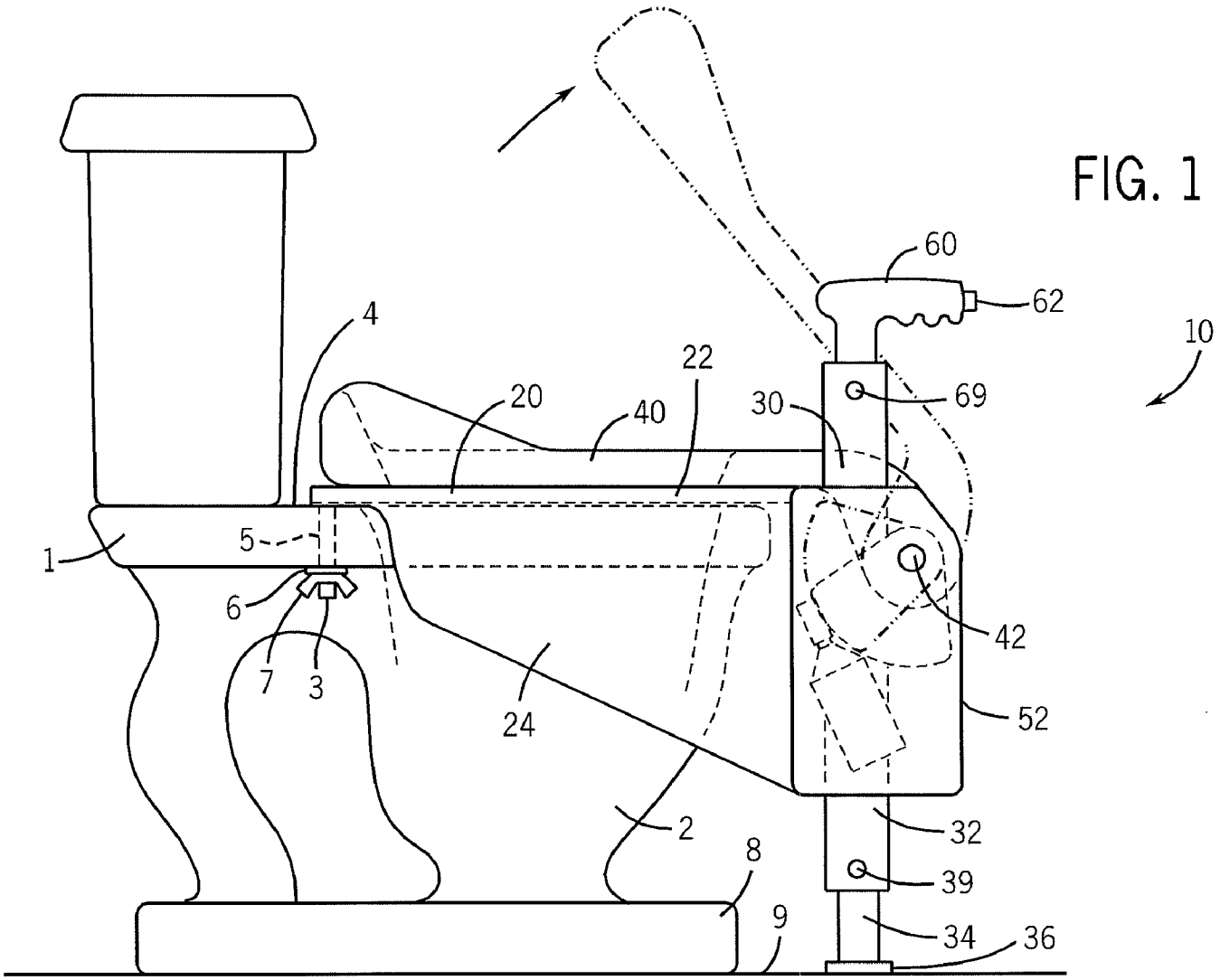
FIG. 1 is a left side elevational view of a lift device constructed in accordance with the present invention as used with a conventional toilet.

Referring now to the drawings in detail, wherein like-numbered elements refer to like elements throughout, FIG. 1 shows the lift device of the present invention, the lift device being identified generally 10. The lift device 10 is configured to replace the existing toilet seat and seat cover (not shown) of a conventional toilet 1. The two bolts (also not shown) in the back of the existing seat and cover combination are first removed from the top planar surface 4 of the toilet bowl 2. The lift device 10 that replaces this old combination generally comprises a skirted first plate-like support portion, generally identified 20, which overlays the top planar surface 4 of the toilet bowl 2, and a second support portion, generally identified 30, which supports the forward elements of the lift device 10.

Figure 2:
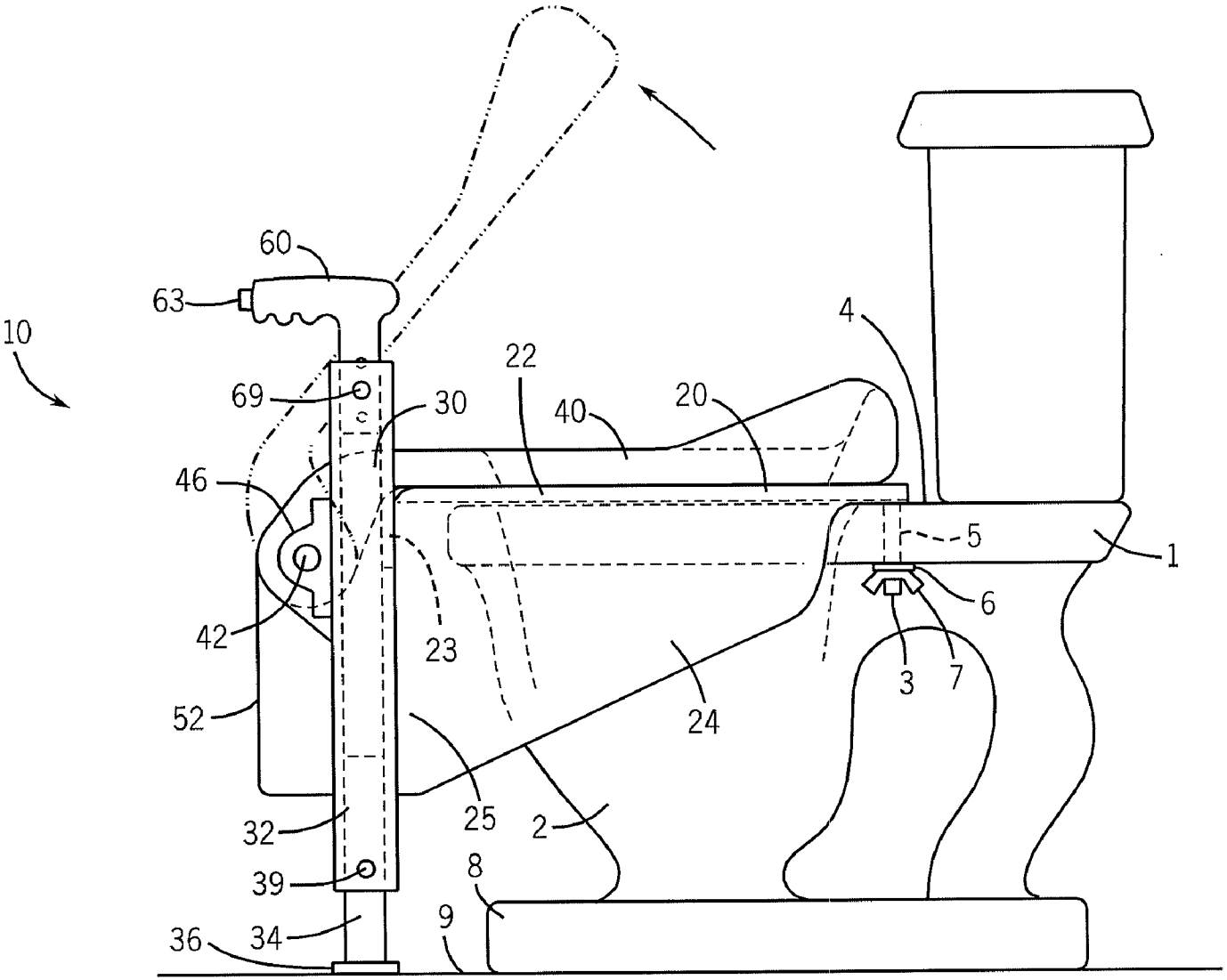
FIG. 2 is a right side elevational view of the lift device shown in FIG. 1.

The first support portion 20 of the lift device 10 comprises a flat plate-like portion 22 that is positioned onto the toilet bowl 2 and two studs 3 are used to locate the device 10 relative to the toilet seat mounting holes 5. The studs 3 are secured with washers 6 and wing nuts 7 or any threaded fastening means. The first support portion 20 further comprises a pair of side plates 24 that extend vertically downwardly from the plate-like portion 22, one plate 24 being disposed to each side of the toilet bowl 2. The first support portion 20 also comprises a downwardly-projecting lip 23, the lip 23 shown in phantom view in FIG. 2, for example.

To the front of the first support portion 20, the second support portion 30 comprises a pair of vertically positioned and fixed support tubes 32, one support tube 32 being disposed to each side of, and slightly forward from, the toilet bowl 2. Each support tube 32 is attached or secured to a vertical forward edge 25 of the adjacent side plate 24 and to the lip 23 that extends between the support tubes 32. See also FIG. 2. Where the first support portion 20 is fabricated from metal, one preferred method of attachment is by welding, although other attachment means could be used, as are known in the art.

Each vertical support tube 32 includes a bottom extensible member 34 and an end foot 36, the bottom extensible member 34 being vertically-adjustable relative to the floor 9. The support tubes 32 and the bottom extensible members 34 are functionally adapted to slidably engage one another, the support tube 32 having a hollow defined in it. The support tubes 32 and the bottom extensible members 34 could have a variety of cross-sectional configurations, including square, round, oblate, and the like, such configuration not being a limitations of the present invention.

A means 39 for securing the relative position between the support tube 32 and its respective bottom extensible member 34 is also provided. For example, a lock screw 39, or other locking member, could be used in combination with a threaded hole 33 in the support tube 32 such that the securing means 39 can lock the extensible member 34 in virtually any vertical position. This allows the end foot 36 to be positioned in any incremental position and, in any event, in the proper vertical position relative to the floor 9, and in the vicinity of each side of the toilet bowl base 8 to either side of the user (not shown). This is true even where the floor 9 is an uneven surface since each bottom extensible member 34 is separately lockable in any required or desired vertical position. It is also within the scope of the present invention that the extensible member 34 may include a male threaded portion (not shown), the male threaded portion being configured to functionally cooperate with a female threaded portion (also not shown) disposed within the support tube 32.

The lift device 10 further comprises a toilet seat 40 and a horizontally-disposed seat pivot shaft 42, the pivot shaft 42 being located within a front portion 41 of the toilet seat 40. The seat pivot shaft 42 is held in axially-rotatable position by means of a pair of bearing blocks or pillow blocks 46, one such block 46 being attached to a support tube 32. Axial rotation of the pivot shaft 42 rotates the front portion 41 of the toilet seat 40. A small reversible electric motor 50 with a worm gear drive 54 engages a worm wheel segment 44 that is attached to one end of the seat pivot shaft 42, the worm wheel segment 44 being keyed or pinned (not shown) to the seat pivot shaft 42. Actuation of the worm gear drive 54 moves the worm wheel segment 44 to raise and lower the toilet seat 40 as desired or required.

The electric motor 50 is wired to an electric cord (not shown) of conventional manufacture, the cord having an end plug (also not shown) that is receivable within a conventional AC outlet (also not shown), such electrical supply means being well known in the art.

Figure 3:
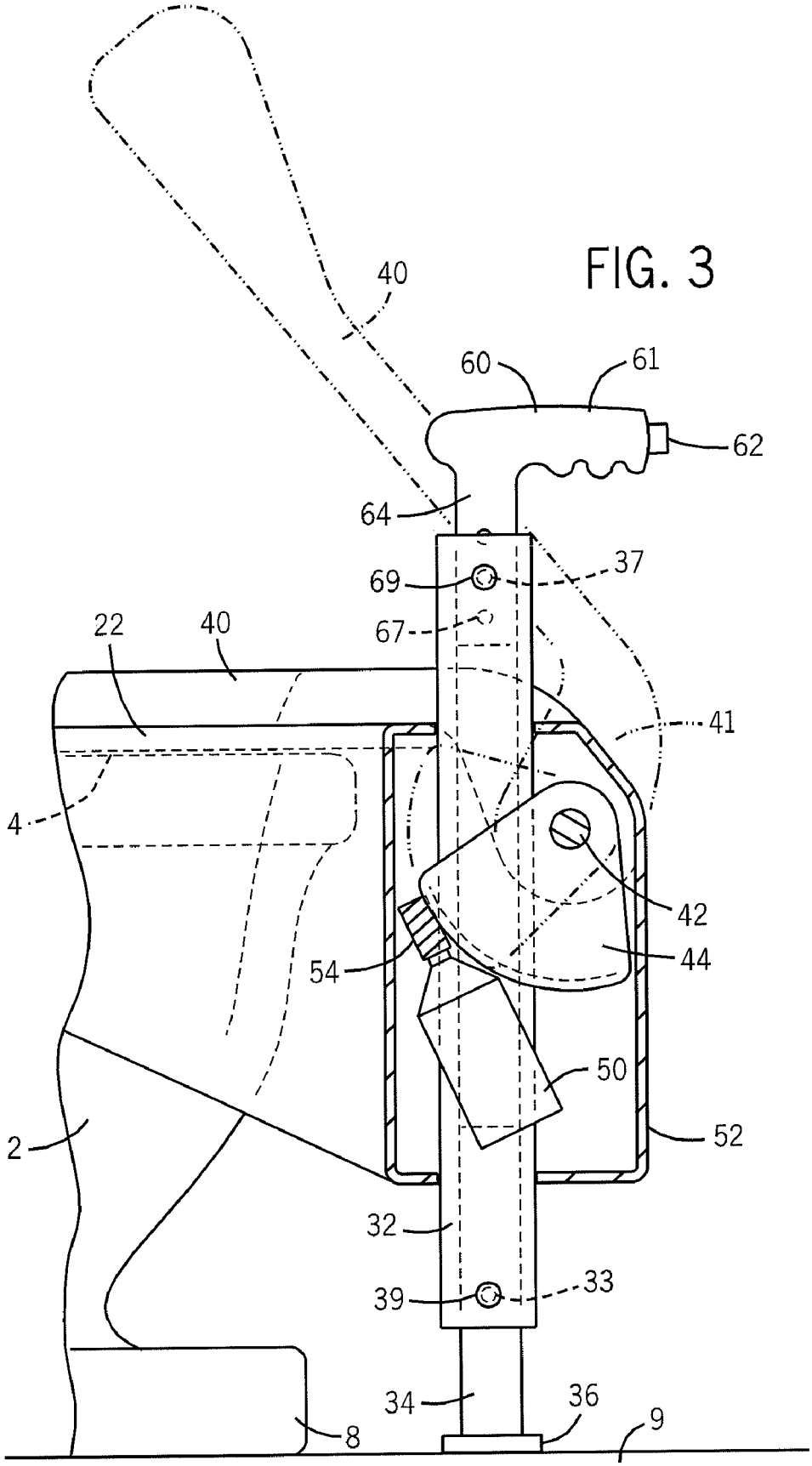
FIG. 3 is an enlarged and partially cross sectioned left side elevational view of the lift device shown in FIG. 1.

The electric motor 50, the worm gear drive 54 and the worm wheel segment 44 are preferably contained within a housing 52. See FIGS. 1 and 3. The housing 52 prevents entrapment of garments worn by the user between the moving parts of this configuration. It is also to be understood that, depending upon space limitations and other factors, that the housing 52 could be placed on either side of the user, the housing 52 and its enclosed components simply being mirror images when placed to either side of the lift device 10.

The raising and lowering of the toilet seat 40 is electrically actuated by the user when a normally open, push button switch (not shown) is actuated, which is when a first push button 62 or a second push button 63, respectively, is depressed. The first push button 62 resides within the right-handed (from the user's perspective) grip-like portion 61 of a support handle 60 which is a combined hand-hold/actuator handle. See FIGS. 1 and 3. This first push button 62 can be depressed to raise the toilet seat 40. A second push button 63 resides within the left-handed grip-like portion 61, the second push button 63 being used to lower the toilet seat 40. That is, seat position is controlled by the depressible push buttons 62, 63, but may also include limit switches (not shown) that are built into the lift device 10. It is to be understood that the push buttons 62, 63 could be replaced, for example, by a rocker switch or other like actuation means. It would also be possible to reverse the push buttons 62, 63 such that the raising button is positioned on the user's left and the lowering button is positioned on the user's right. In any event, actuation of one or both of the push buttons 62, 63 operates the device 10 as intended and the circuitry is such that depression of one button 62, 63 and actuation of the device 10 is not counteracted or defeated by depression of the other button 62, 63 at the same time. Put another way, depression of one button 62, 63 with the resulting functionality cannot be overridden by subsequent depression of the other button 62, 63.

In the preferred embodiment, a means for securing the relative height of the support handle 60 is also provided by means of an extensible portion 64 of the handle 60. A lock pin 69, including a spring-loaded lock pin, can be used in combination with an upper hole 37 in the support tube 32 and aligned holes 67 in the support handle 60 so as to allow the support handle 60 to be positioned in the proper vertical position for the comfort of the user. See FIG. 3. Alternatively, it would be possible to use the same securing means at the support handle 60 as previously described relative to the bottom extensible member 34. However, spring-loaded lock pins 69 are preferred for ease of use when adjusting the height of the support handles 60. It would also be possible to insert a simple pin which would be a less expensive, but not a preferred, alternative.

Figure 4:
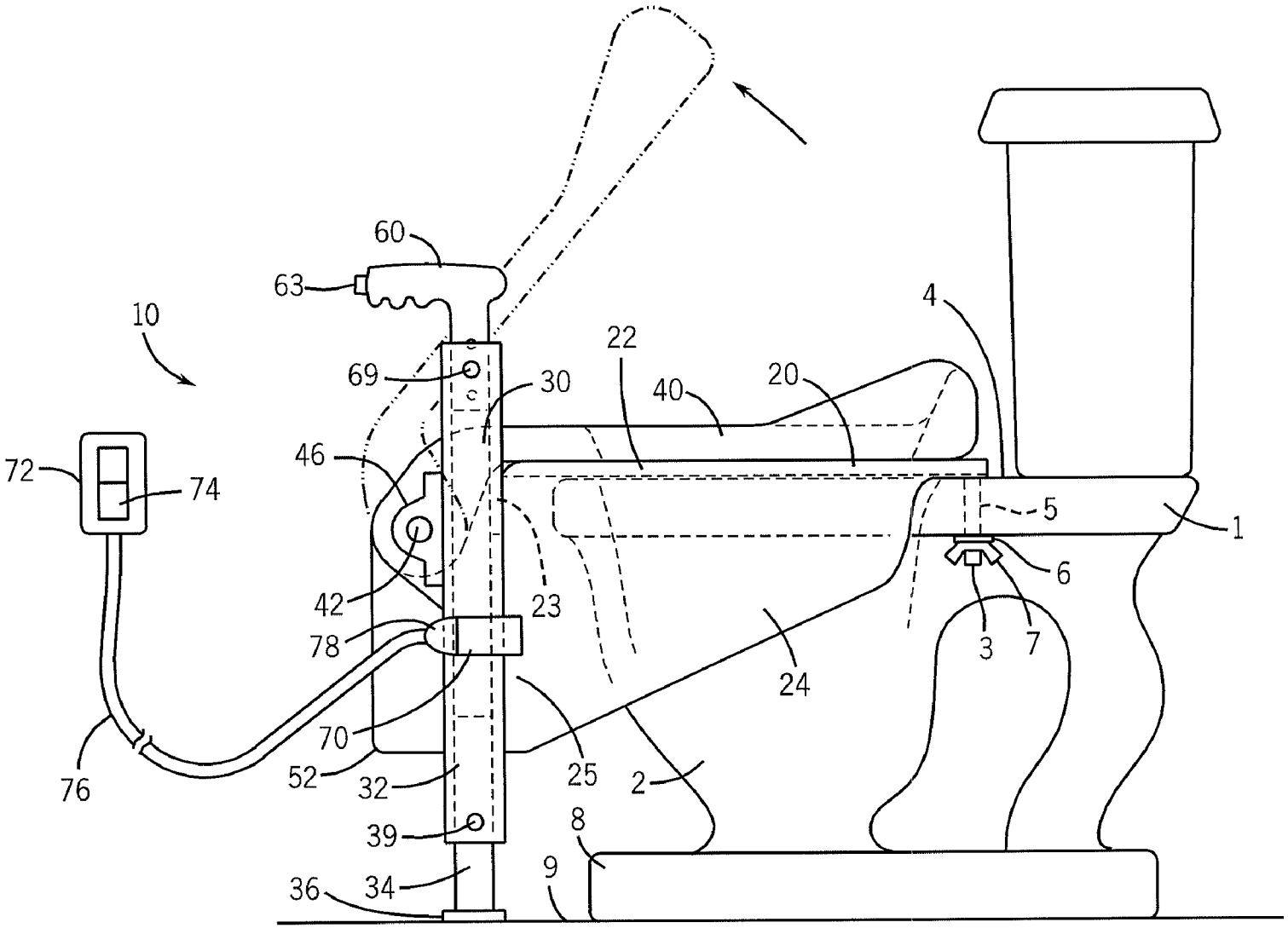
FIG. 4 is a view that is similar to FIG. 2 but which illustrates an accessory for actuation of the lift mechanism used in the lift device of the present invention by someone other than the user.

The toilet seat 40 can also be raised and lowered by an assistant-actuated remote control device, including an assistant-actuated override-type device, used by a care giver when the user is assisted by the care giver. See FIG. 4. In this configuration, a plug receptacle 70 is provided whereby a remote control device 72 having a cord 76 and plug 78 can be electrically connected to the plug receptacle 70. The remote control device 72 includes a rocker switch 74 which provides the care giver with one-handed actuation capabilities, thus freeing the other hand for assistance to the user when needed. It is to be noted that, when the remote control device 72 is plugged into the lift device 10, the up/down buttons 62 are electrically disabled, thus giving total control of the device 10 to the care giver. This prevents accidental or unintentional user actuation should one or both of the buttons 62 be depressed during use of the remote control device 72. Unplugging the remote control device 72 restores user control.

In accordance with the foregoing, it will be appreciated that a new, useful and non-obvious lift device has been provided that utilizes a portion of the toilet seat itself as the primary vehicle for lowering and raising an individual. The lift device is capable of being used with, and secured to, a wide variety of toilet bowls of conventional manufacture. The lift device has a minimal footprint for suitable use within a variety of settings, including areas where clearance might otherwise be an issue. The lift device is alternatively operable by the user or by a care giver of the user.

The details of the invention having been disclosed in accordance with the foregoing, we claim:

1. A lift device for use with a toilet, the toilet having a toilet bowl with a top planar surface, comprising:

a first support portion positioned in direct contact with the top planar surface of the toilet bowl, the first support portion having a plate extending downwardly to each side of the toilet bowl, each plate having a forward portion;

a second support portion comprising a pair of vertical fixed support tubes and a member slidably movable within each tube, the forward portion of each plate of the first support portion being attachable to one of the support tubes from the pair of support tubes;

a rotatable toilet seat comprising a front portion and a back portion and a pivot shaft disposed within the front portion, the pivot shaft having a first end;

a worm wheel segment attached to the first end of the pivot shaft;

an electric motor comprising a worm gear drive that is movable when the electric motor is actuated;

a housing, wherein the motor, the worm gear drive and the worm wheel segment are contained within the housing; and means for selectively driving the electric motor in a first direction that causes rotation of the pivot shaft and brings the back portion of the toilet seat upward and forward, and in a second direction that causes opposite rotation of the pivot shaft and brings the back portion of the toilet seat downward and rearward.

2. The lift device of claim 1 wherein each slidably movable member comprises a bottom end and the lift device further comprises a foot disposed at such bottom end, means for securing the vertical position of such foot and a support handle disposed atop each support tube.

3. The lift device of claim 2 wherein each support handle comprises means for actuating the motor.

4. The lift device of claim 3 wherein the motor actuating means comprises a push button disposed within the support handle and a normally open, push button switch.

5. The lift device of claim 4 wherein the support handles are vertically adjustable and the device further comprises means for securing the vertical position of each support handle.

6. The lift device of claim 5 wherein the handle position securing means comprises a plurality of holes defined within the support handle, a pair of transversely aligned holes defined within the support tube and a pin that inserted into collinear holes.

7. The lift device of claim 6 wherein the pin is a spring-loaded pin.

8. The lift device of claim 5 wherein the support handle position locking means comprises a lock screw.

9. The lift device of claim 1 wherein the device further comprises a remote control device and a receptacle for the remote control device such that, when electrically connected to the receptacle, the remote control device disables the support handle switches and buttons and allows actuation of the motor.

10. A lift device for use with a toilet, the toilet having a toilet bowl with a top planar surface, which comprises:

a first support portion positioned in direct contact with the top planar surface of the toilet bowl;

a second support portion comprising a pair of vertical support tubes and vertically movable members within each tube;

a toilet seat comprising a front portion and a back portion;

a pivot shaft disposed within the front portion of the toilet seat, the pivot shaft having a first end;

a worm wheel segment attached to the first end of the pivot shaft;

an electric motor;

a worm gear drive that is movable when the electric motor is actuated; and means for selectively driving the electric motor in first and second directions;

wherein actuation of the electric motor in the first direction causes rotation of the pivot shaft and brings the back portion of the toilet seat upwardly and forwardly, and actuation of the electric motor in the second direction reverses rotation of the pivot shaft and brings the back portion of the toilet seat downwardly and rearwardly.

11. The lift device of claim 10 wherein the vertically movable members comprise a bottom member having a foot and an upper support handle.

12. The lift device of claim 11 wherein each support handle comprises means for actuating the motor.

13. The lift device of claim 12 wherein the motor actuating means comprises a push button and a normally open, push button switch disposed with the support handle.

14. The lift device of claim 13 wherein the device further comprises means for securing the vertical position of the vertically movable members.

15. The lift device of claim 14 wherein the vertical position securing means comprises a plurality of holes defined within the support handle, a pair of transversely aligned holes defined within the support tube and a pin that is inserted into collinear holes.

16. The lift device of claim 15 wherein the pin is a spring-loaded pin.

17. The lift device of claim 14 wherein the vertical position securing means comprises at least two holes defined within the support tube and at least two lock screws.

18. The lift device of claim 10 wherein the device further comprises a housing, wherein the motor, the worm gear drive and the worm wheel segment are contained within the housing.

19. The lift device of claim 13 wherein the device further comprises a remote control device and a receptacle for the remote control device such that, when electrically connected to the receptacle, the remote control device disables the support handle switches and buttons and allows actuation of the motor.

* * * * *